US007664419B2

(12) United States Patent
Matoba

(10) Patent No.: US 7,664,419 B2
(45) Date of Patent: Feb. 16, 2010

(54) WORK FLOW MANAGEMENT APPARATUS AND WORK FLOW MANAGEMENT METHOD

(75) Inventor: Tatsuo Matoba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 11/849,519

(22) Filed: Sep. 4, 2007

(65) Prior Publication Data

US 2008/0063423 A1 Mar. 13, 2008

(30) Foreign Application Priority Data

Sep. 8, 2006 (JP) ..... 2006-244601

(51) Int. Cl.
*G03G 15/00* (2006.01)
*G03G 21/00* (2006.01)
*G03G 21/02* (2006.01)

(52) U.S. Cl. ..... 399/80; 399/75; 399/79

(58) Field of Classification Search ..... 399/75, 399/79, 80, 87
See application file for complete search history.

(56) References Cited

U.S. PATENT DOCUMENTS 7,023,571 B2 * 4/2006 Shimada et al. ..... 358/1.14
2005/0219611 A1 * 10/2005 Yamashita et al. ..... 358/1.15
2007/0003306 A1 * 1/2007 Jacobsen et al. ..... 399/79

FOREIGN PATENT DOCUMENTS

JP 2004-152139 A 5/2004

* cited by examiner

*Primary Examiner*—David M Gray
*Assistant Examiner*—Rodney Bonnette
(74) *Attorney, Agent, or Firm*—Canon USA, Inc. IP Division

(57) ABSTRACT

An apparatus manages a usage amount associated with each of a plurality of functions included in a work flow. The work flow is executed after it is determined whether an operation of each step included in the work flow can be executed or not.

10 Claims, 11 Drawing Sheets

FIG. 5

500

501

502

```
...
<workflow wfid="fid_001" caption="BINDING PRINT REQUEST " standard="10day" limit="20day" step="5" ...>
        ...
</workflow>
<workflow wfid="fid_002" caption="DISTRIBUTION MATERIAL PRINT REQUEST" standard="5day" limit="15day" step="3" ...>  >
        <activity actid="aid_req_001" role="everyone" caption="APPLICATION " seq="1" ...>
                <action type="scan" counter_coefficient="1"/>
                <action type="send" counter_coefficient="1"/>
        </activity>
        <activity actid="aid_recog_001" role="superior" caption="ACKNOWLEDGMENT" seq="2" ...>
                <action type="send" counter_coefficient="1"/>
        </activity>
        <activity actid="aid_print_001" role="operator" caption=" PRINT " seq="3" ...>
                <action type="print" counter_coefficient="1"/>
        </activity>
        <comment> REQUESTING PRINT OF SPECIFIED NUMBER OF COPIES AS DISTRIBUTION MATERIAL </comment>
</workflow>
<workflow wfid="fid_003" caption=" NAME CARD PRINT REQUEST " standard="3day" limit="10day" step="3" ...>
        ...
</workflow>
<workflow wfid="fid_004" caption=" POSTER CREATION REQUEST " standard="5day" limit="15day" step="3" ...>
        ...
</workflow>
<workflow wfid="fid_005" caption="DOCUMENT ELECTRONIC CONVERSION REQUEST " standard="2day" limit="10day" step="3" ...>
        ...
</workflow>
...
```

FIG. 6

600

| 601 USER ID | 602 FUNCTION TYPE | 603 SWITCHING DATE AND TIME | 604 UPPER LIMIT USE AMOUNT | 605 USED AMOUNT | 606 RESERVED USE AMOUNT INFORMATION | | | | |
|---|---|---|---|---|---|---|---|---|---|
| | | | | | 6061 RESERVATION JOB ID | 6062 RESERVED USE AMOUNT | RESERVATION JOB ID | RESERVED USE AMOUNT | ··· |
| kato | print | 07/01/06 0:0:0 | 100000 | 85200 | f350/3 | 10000 | f352/3 | 250 | ··· |
| kato | scan | 07/01/06 0:0:0 | 1000 | 963 | f352/2 | 10 | — | — | ··· |
| kato | send | 07/01/06 0:0:0 | 100 | 56 | f352/2 | 1 | — | — | ··· |
| kato | disk | 07/01/06 0:0:0 | 8192 | 1560 | f352/3 | 256 | — | — | ··· |
| kato | time | 07/01/06 0:0:0 | 1440 | 720 | f350/3 | 30 | f352/3 | 30 | ··· |
| sato | print | 07/01/06 0:0:0 | 5000 | 1230 | — | — | — | — | ··· |
| sato | scan | 07/01/06 0:0:0 | 500 | 123 | — | — | — | — | ··· |
| sato | send | 07/01/06 0:0:0 | 50 | 23 | — | — | — | — | ··· |
| sato | disk | 07/01/06 0:0:0 | 1024 | 122 | f349/3 | 22 | — | — | ··· |
| sato | time | 07/01/06 0:0:0 | 480 | 120 | f349/3 | 3 | — | — | ··· |
| suzuki | print | 07/01/06 0:0:0 | 5000 | 3210 | f348/5 | 200 | — | — | ··· |
| suzuki | scan | 07/01/06 0:0:0 | 500 | 65 | f348/5 | 2 | — | — | ··· |
| suzuki | send | 07/01/06 0:0:0 | 100 | 5 | f348/5 | 1 | — | — | ··· |
| suzuki | disk | 07/01/06 0:0:0 | 1024 | 256 | f348/5 | 64 | — | — | ··· |
| suzuki | time | 07/01/06 0:0:0 | 480 | 96 | f348/5 | 4 | — | — | ··· |
| ito | print | 07/01/06 0:0:0 | 2000 | 1470 | — | — | — | — | ··· |
| ito | scan | 07/01/06 0:0:0 | 200 | 45 | — | — | — | — | ··· |
| ito | send | 07/01/06 0:0:0 | 20 | 2 | — | — | — | — | ··· |
| ito | disk | 07/01/06 0:0:0 | 512 | 50 | — | — | — | — | ··· |
| ito | time | 07/01/06 0:0:0 | 240 | 60 | — | — | — | — | ··· |
| kimura | print | 07/01/06 0:0:0 | 1000 | 654 | f350/3 | 100 | — | — | ··· |
| kimura | scan | 07/01/06 0:0:0 | 100 | 25 | f350/3 | 1 | — | — | ··· |
| kimura | send | 07/01/06 0:0:0 | 5 | 5 | — | — | — | — | ··· |
| kimura | disk | 07/01/06 0:0:0 | 256 | 64 | f350/3 | 32 | — | — | ··· |
| kimura | time | 07/01/06 0:0:0 | 240 | 120 | — | — | — | — | ··· |
| ··· | ··· | ··· | ··· | ··· | ··· | ··· | ··· | ··· | ··· |

FIG. 7

700

| 701 FLOW JOB ID | 702 START DATE AND TIME | 703 START USER ID | 704 FLOW ID | 705 DESIRED COMPLETION DATE AND TIME | 706 CURRENT STATUS | 707 COMPLETED STATUS | 708 PRIORITY | 709 COMPLETION DEADLINE DATE AND TIME | --- |
|---|---|---|---|---|---|---|---|---|---|
| --- | --- | --- | --- | --- | --- | --- | --- | --- | --- |
| f_348 | 05/23/06 10:00 | suzuki | fid_001 | 06/10/06 09:00 | 4/5 | — | low | 06/02/06 10:00 | --- |
| f_349 | 05/25/06 09:00 | sato | fid_003 | 05/26/06 17:00 | 3/3 | ok | high | 06/04/06 09:00 | --- |
| f_350 | 05/26/06 10:30 | kimura | fid_002 | 06/05/06 09:00 | 3/3 | ok | normal | 06/10/06 10:30 | --- |
| f_351 | 05/26/06 17:30 | ito | fid_005 | 05/31/06 10:00 | 2/3 | — | normal | 06/05/06 17:30 | --- |
| f_352 | 05/27/06 08:30 | kato | fid_003 | 06/05/06 18:00 | 1/3 | cancel | normal | 06/06/06 08:30 | --- |
| --- | --- | --- | --- | --- | --- | --- | --- | --- | --- |

FIG. 8

800

| 801 JOB ID | 802 FUNCTION TYPE | 803 RESULT | 804 JOB NAME | 805 ADDRESS | 806 START TIME | 807 USE AMOUNT | ··· | 808 USER ID | 809 FLOW/JOB ID | ··· |
|---|---|---|---|---|---|---|---|---|---|---|
| ··· | ··· | ··· | ··· | ··· | ··· | ··· | ··· | ··· | ··· | ··· |
| 2540 | scan | OK | REVIEW MATERIAL.doc | — | 05/25/06 10:30:30 | 25 | ··· | kimura | f_350 | ··· |
| 2541 | send | OK | REVIEW MATERIAL.doc | sato | 05/26/06 10:32:00 | 1 | ··· | kimura | f_350 | ··· |
| 2542 | copy | STOP | 060501113030 | — | 05/26/06 11:30:30 | 2 | ··· | suzuki | — | ··· |
| 2543 | send | OK | REVIEW MATERIAL.doc | kato | 05/29/06 08:35:00 | 1 | ··· | sato | f_350 | ··· |
| 2544 | copy | ERR | 060502153000 | — | 05/29/06 15:30:00 | 32 | ··· | ito | — | ··· |
| 2545 | print | OK | REVIEW MATERIAL.doc | — | 05/29/06 17:30:00 | 1000 | ··· | kato | f_350 | ··· |
| ··· | ··· | ··· | ··· | ··· | ··· | ··· | ··· | ··· | ··· | ··· |

WORK FLOW MANAGEMENT APPARATUS AND WORK FLOW MANAGEMENT METHOD

BACKGROUND OF THE INVENTION

1. Field of the Invention

The present invention relates to an apparatus (e.g., image forming apparatus such as multi-function peripheral (MFP)) capable of managing usage of various functions (e.g., printing function) and a work flow management method.

2. Description of the Related Art

A document work flow structured by a series of operations in which a plurality of functions are combined is executed in an office or other places by utilizing functions of an image forming apparatus represented by an MFP (Multi Function Peripheral).

Hereinafter, an example of the document work flow will be described. When a user A desires to print 1000 copies of distribution materials, after 10 pages of originals are scanned in the MFP, the user A notifies a supervisor B of the user A of an acknowledgment request. Next, the supervisor B checks its content from a PC or the like. When the supervisor B acknowledges the request, a notification is delivered to an operator C. Then, the operator C prints MFP 1000 copies (10000 pages) of the originals in the MFP. In other words, this document work flow is structured by an original setting step (client), an acknowledgment step (acknowledger), and a printing step (operator).

In addition, an image forming apparatus capable of performing upper limit value management for limiting the usage is known in which for a purpose of accounting management or output suppression, an upper limit value is set for the number of sheet that can be printed in a certain period of time for each user or each group, for example.

Moreover, Japanese Patent Laid-Open No. 2004-152139 discloses an image forming apparatus configured to control an upper limit count value set for each job ID, a current count value that is counted in accordance with an output process, and a reservation count value to be reserved. In this image forming apparatus, when it is determined that an addition result of the count value used in the output of the reservation job and the current count value exceeds the upper limit value and also when a guaranty mode is set in the reservation job, the reservation job is cancelled. As a result, the technology disclosed in Japanese Patent Laid-Open No. 2004-152139 describes that, after the process of the reservation job is started, such a situation is prevented from occurring that the process is not completed as the upper limit value is reached until the process of the reservation job is completed.

However, according to the conventional technologies, such a control that the upper limit values for a plurality of functions are managed to complete a work flow structured by a plurality of operation steps is not envisioned.

In addition, according to the conventional technologies, such a control that the upper limit values for a plurality of functions are integrally managed for a work flow in which a plurality of operation steps are sequentially processed is not also envisioned.

According to the technology disclosed in Japanese Patent Laid-Open No. 2004-152139, it is impossible to cope with a case where a time lag is generated from the instruction of the process start until the completion of the process as in the work flow. For example, the work flow takes time until the series of processes are completed as the time lag is generated between the first process step and the last process step as a plurality of process steps are prepared. For this reason, it can be considered that there is a room until the upper limit use amount at the time of the work flow start but at the time when the process of the work flow actually reaches the user, the user executes another job. Then, no room is available in the use amount that can be used by the user because the other job has been executed. Regarding the work flow process, for example, the print counter number becomes insufficient and the process cannot be performed. As a result, there is a problem in that the work flow is retarded.

According to the technology disclosed in Japanese Patent Laid-Open No. 2004-152139, such a case where a time lag is generated from the process start until the completion of the process as in the work flow, a process different from the work flow is executed during this period, and the process of the work flow cannot be performed is not envisioned. As a result, according to the conventional technology, such a situation may occur in which even though the start of the work flow has been instructed, the processing of the work flow cannot be completed.

SUMMARY OF THE INVENTION

An embodiment of the present invention has been made in view of the above-described problems and allows a work flow to be smoothly carried forward even in a status where a use amount that can be executed is limited with respect to a use who executes a process of an operation step included in the work flow.

Therefore, according to an aspect of the present invention, there is provided an apparatus (e.g., image forming apparatus such as multi-function peripheral (MFP)), including a management unit configured to manage an upper limit value of a use amount for each of a plurality of different functions (e.g., printing function, scanning function, transmitting function, storing function) in a plurality of steps included in a work flow; a calculation unit configured to calculate a use amount related to each function required for processing process information requested in the work flow before the work flow structured by the plurality of steps is executed; a determination unit configured to determine whether an operation in each step included in the work flow which uses the use amount can be executed or not on the basis of the upper limit value managed by the management unit and the use amount calculated by the calculation unit; and a use amount control unit configured to reserve, as a value managed by the management unit for each function, the use amount related to each function which is calculated by the calculated unit before the work flow is executed when it is determined that the operation which uses the use amount calculated by the calculation unit can be executed on the basis of a determination result of the determination unit.

With the above-described configuration, it is possible to predict and calculate the use amount related to each function included in the work flow at the time of the work flow start for each user and to ensure the amount as the reserved use amount. As a result, it is possible to avoid such a situation that even there is a room for the upper limit value for the use amount at the starting time but the user executes another job before the work flow process reaches the user and the use amount approaches the upper limit value and the work flow process cannot be performed. Thus, it is possible to smoothly carry forward the work flow.

Further features of the present invention will become apparent from the following description of exemplary embodiments with reference to the attached drawings.

BRIEF DESCRIPTION OF THE DRAWINGS

FIG. 5 illustrates an example of a work flow information storage table that is a part of a work flow information storage unit.

FIG. 6 illustrates an example of an upper limit use amount storage table that is a part of an upper limit amount storage unit 2041.

FIG. 7 illustrates an example of a work flow execution status management table that is a part of a work flow status storage unit.

FIG. 8 illustrates an example of a job history management table that is a part of a job history storage unit.

DESCRIPTION OF THE EMBODIMENTS

Hereinafter, embodiments of the present invention will be described with reference to the drawings.

First Exemplary Embodiment

Figure 1:
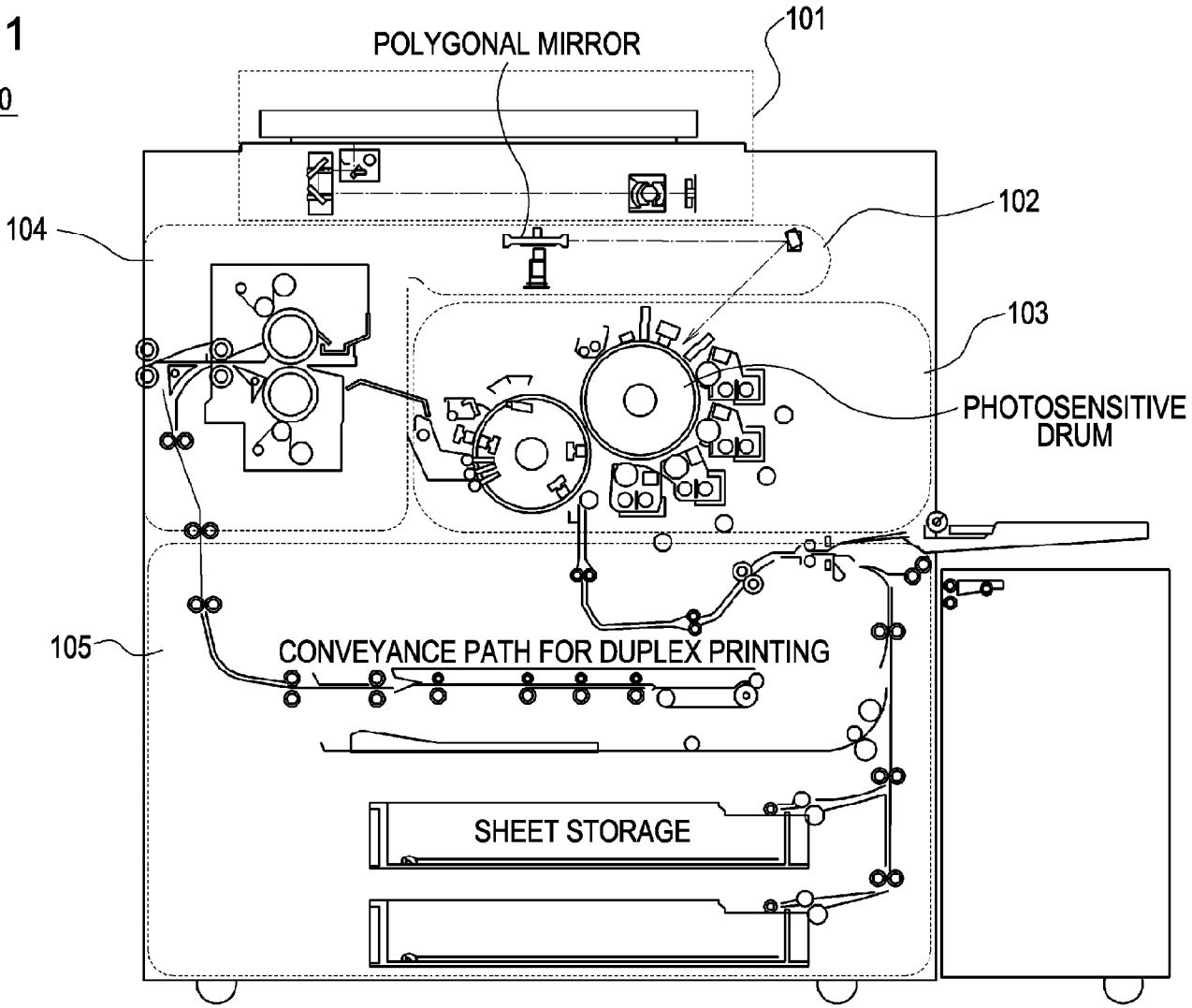
FIG. 1 illustrates an example of an internal configuration of an MFP according to an embodiment of the present invention.

FIG. 1 illustrates an example of an internal configuration of an MFP according to an embodiment of the present invention. It is noted that in FIG. 1, a description is provided while taking a 1D color system MFP as an example. Herein, the MFP has a full color apparatus and a monochrome apparatus. In many cases, the full color apparatus includes basic compositions of the monochrome apparatus other than a color process, internal data, and the like, and thus, the full color apparatus will be mainly described in FIG. 1.

An MFP 100 functioning as the 1D color system MFP includes a scanner unit 101, a laser exposure unit 102, a photosensitive drum, an image formation unit 103, a fixing unit 104, a sheet feed/conveyance unit 105, a MFP control unit 200 (shown in FIG. 2) configured to control the above-described components, and the like.

The scanner unit 101 irradiates an original placed on an original plate with illumination to optically read an original image and convert the image into electronic signals for creating image data.

The laser exposure unit 102 causes laser light such as laser light modulated in accordance with the image data to be incident on a rotatable polygonal mirror rotating at a constant angular velocity and irradiates the photosensitive drum with the light as reflected scanning light.

The image formation unit 103 rotates and drives the photosensitive drum, performs charging by using a charger, develops with toner a latent image formed on the photosensitive drum by the laser exposure unit 102, and transfers the toner image onto a sheet. Then, the image formation unit 103 recovers minute toner which is not transferred at that time and left on the photosensitive drum. The image formation unit 103 executes a series of electrophotography processes to form an image. At that time, the sheet is wound at a predetermined position of a transfer belt. While four rotations are made, developing units (developing stations) respectively having toner of magenta (M), cyan (C), yellow (Y), and block (K) alternately perform the above-described electrophotography processes repeatedly in sequence. After the four rotations are made, the sheet on which full color toner images of the four colors are transferred leaves the transfer drum and conveyed to the fixing unit 104.

The fixing unit 104 is composed of a combination of a roller and a belt. The fixing unit 104 has a built-in heat source such as a halogen heater and melts and fixes the toner on the sheets on which the toner images are transferred by the image formation unit 103 by way of heat and pressure.

The sheet feed/conveyance unit 105 is provided with at least one sheet storage represented by a sheet cassette and a paper deck. In response to an instruction of the MFP control unit 200, one sheet is separated from a plurality of sheets accommodated in the sheet storage and conveyed to the image formation unit 103 and the fixing unit 104. The sheet is wound around the transfer drum of the image formation unit 103, and is conveyed to the fixing unit 104 after the four rotations are made. While the four rotations are made, the above-described toner images of the YMCK colors are transferred to the sheet. Also, when the image formation is performed on both sides of the sheet, such a control is carried out that the sheet feed/conveyance unit 105 causes the sheet which has passed through the fixing unit 104 to pass through a conveyance path so as to be conveyed to the image formation unit 103 again.

The MFP control unit 200 executes an overall control on the MFP 100 and at the same time performs such instructions that the entire apparatus can be smoothly operated in a fine balance while statuses of the above-described units for the scanning, the laser exposure, the image formation, the fixation, and the sheet feed/conveyance are controlled.

With regard to the configuration of the system according to the present embodiment, a plurality of MFPs may be provided. Also, the system according to the present embodiment may be composed of a combination of the MFP and an SFP (Single Function Peripheral) such as a single function type image forming apparatus provided with a print function. In addition, the system according to the present embodiment may be composed of a combination of the MFP and a PC (Personal Computer). Any configuration may be adopted as long as a control according to the present embodiment to be described below can be realized.

Figure 2:
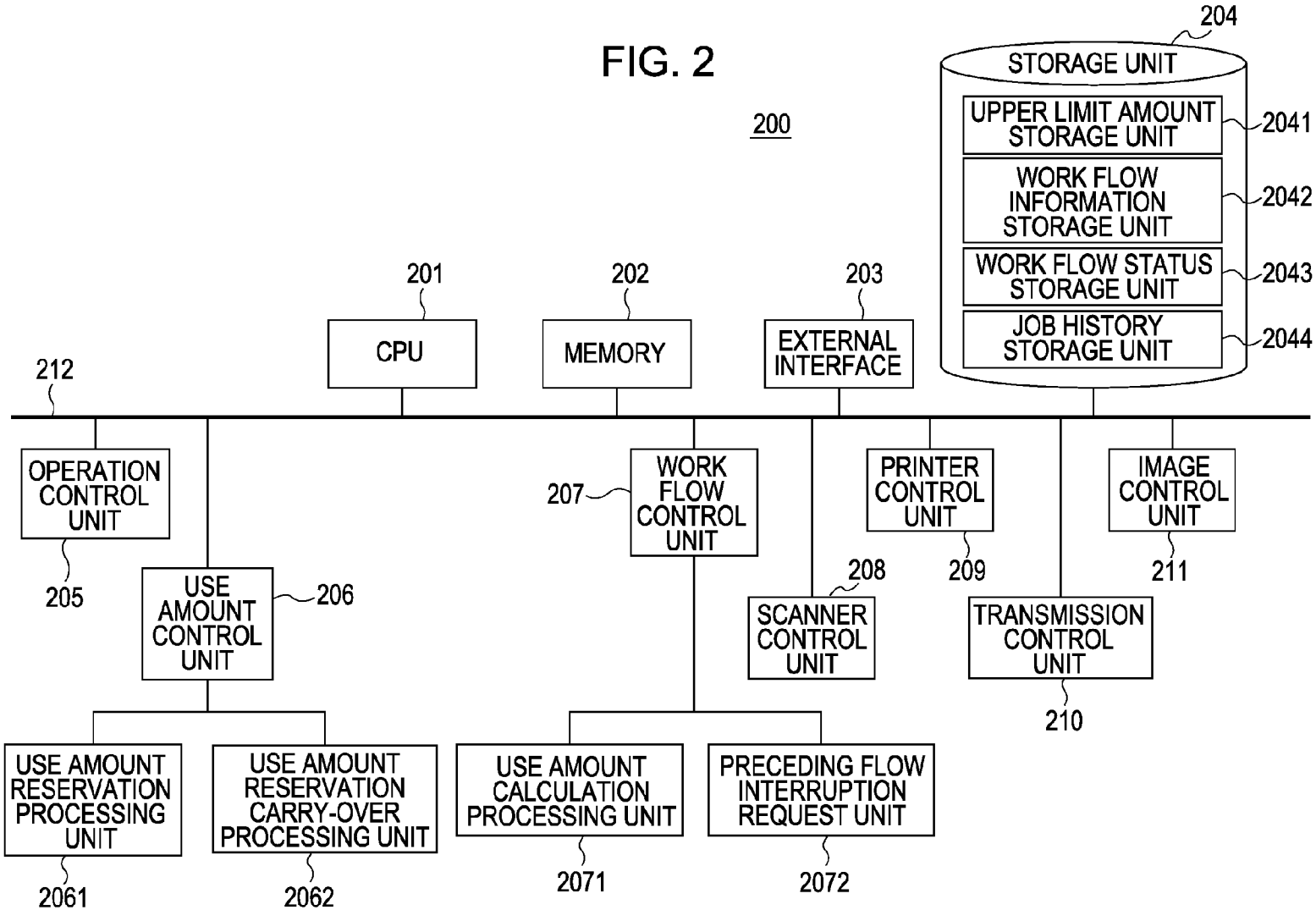
FIG. 2 is a block diagram of a configuration of an MFP control unit of the MFP.

FIG. 2 is a block diagram of a configuration of the MFP control unit 200 of the MFP 100 shown in FIG. 1. In FIG. 2, process modules 205, 206, 2061, 2062, 207, 2071, 2072, 208, 209, 210, and 211 constitute the MFP control unit 200. In an embodiment, these process modules are modules operating as a part of an application program or a program executed in a CPU 201.

In FIG. 2, information storage apparatuses 204, 2041, 2042, 2043, and 2044 constitute the MFP control unit 200 and store information by using a file system or a database system in a non-volatile hard disk, a memory, or the like. Then, it is possible to directly access the information stored in the information storage apparatuses 204, 2041, 2042, 2043, and 2044 by way of a specific key or condition.

The CPU 201 controls the entirety of the MFP 100 and realizes the operations such as scan, print, and facsimile by reading out and executing a program stored in a memory 202 or a storage unit 204 to issue instructions to the respective units.

The memory 202 is composed of a ROM for storing various programs to be executed by the CPU 201, a RAM for temporarily storing necessary data for the control or the like. The various programs correspond to a use amount control unit 206, a use amount reservation processing unit 2061, a use amount reservation carry-over processing unit 2062, a work flow control unit 207, a use amount calculation processing unit 2071, a preceding flow interruption request unit 2072, and other units.

An external interface 203 exchanges information with an external apparatus via a network or the like.

The storage unit 204 includes a memory such as a non-volatile memory like a hard disk drive. The storage unit 204 stores, for example, the image data generated in the respective processes as well as control information and setting information used for respective processes. The storage unit 204 is provided with an upper limit amount storage unit 2041, a work flow information storage unit 2042, a work flow status storage unit 2043, a job history storage unit 2044, and the like. In addition, although not illustrated in the drawing herein, the storage unit 204 may store user information managed in an authentication system (not illustrated). It is noted that instead of the ROM of the memory 202, the various programs may be stored in the storage unit 204. When data is read or written with respect to the use amount control unit 206, the read or write is performed via the memory 202.

The upper limit amount storage unit 2041 stores an ID for a user or a group, and an upper limit amount within a certain period of time, a used amount, and a reserved use amount with respect to the functions such as print, scan, send, and disk used amount.

The work flow information storage unit 2042 stores a list of the work flows that can be executed in the MFP 100 and information of jobs constructing the respective work flows.

The work flow status storage unit 2043 stores process statuses of the executed work flows. The job history storage unit 2044 stores a history of the jobs executed in the MFP 100.

The operation control unit 205 controls a touch panel unit and a key input unit which are not illustrated herein and transmits information generated in response to operations of these units by the user to the respective units.

The use amount control unit 206 controls a use amount for each ID such as a user or a group related to the operation executed in the MFP 100 by the user or the system. Examples of the use amount include a print counter, a scanner counter, a capacity of the image data, an operation time.

The print counter is a value to be counted up in accordance with the print process executed in the printer unit.

The scanner counter is a value to be counted up in accordance with the scan process executed in the scanner unit.

A transmission and reception counter is a value to be counted up in accordance with transmission and reception of a facsimile or the like.

The capacity of the image data is a capacity of the image data stored in the storage unit 204 by the user.

The operation time is an operation time during which the user operates the MFP 100.

The use amount control unit 206 adds various use amounts for each ID and grasps the use amounts by using the upper limit amount storage unit 2041. Then, in a case where an upper limit value in a certain period set for each ID (for example, on a monthly basis) is set for the use amount, if the use amount reaches the upper limit value in the certain period, the use amount control unit 206 puts restrictions so that the MFP 100 does not perform the process corresponding to the ID any longer (i.e., until the currently calculated used amount is reset at the switching date and time). It is noted that the upper limit value in a context of the present specification refers to a use amount that can be executed by the operator. For example, in an embodiment, a value fixedly set as the printable sheet number per month and the number of sheet that can be executed by the user which varies from the value fixedly set as the printable sheet number per month in accordance with the print process are also set as the upper limit values. In other words, when 1000 is set as the printable sheet number per month, for example, 1000 is the upper limit value. When the remaining number of the printable sheets is 700 as a result of print of 300 sheets, 700 also becomes the upper limit value.

The use amount reservation processing unit 2061 is operated as a part of the use amount control unit 206. Then, before the user executes the work flow or the job, the use amount reservation processing unit 2061 ensures the use amount such as the counter used for processing the work flow or the job in advance.

The use amount reservation carry-over processing unit 2062 is operated as a part of the use amount control unit 206. When it is determined that the use amount ensured by the use amount reservation processing unit 2061 exceeds the counting period of the upper limit value set in the ID before actually used, the use amount reservation carry-over processing unit 2062 carries over the unprocessed reserved use amount before the switching date and time as a reserved use amount after the switching date and time. As an example where the counting period of the upper limit value is exceeded, when the management of the upper limit value is performed on a monthly basis, in accordance with the month change, the use amount reserved for the month before the change is reserved for a use amount for a month after the change.

The work flow control unit 207 controls the work flow structured by a plurality of steps as a series of processes executed by the user or the system by using the MFP 100. The work flow control unit 207 manages the list of the executable work flows and grasps the execution status of the work flow by using the work flow information storage unit 2042, the work flow status storage unit 2043, and the like. In addition, the work flow control unit 207 also controls the execution of predetermined exceptional processes and the like.

The use amount calculation processing unit 2071 is operated as a part of the work flow control unit 207. Then, the use amount calculation processing unit 2071 predicts and calculates a required use amount for the respective processes in each step included in the course of the work flow from the selected work flow type, the original selected upon the request, etc. when the user starts the work flow by using the MFP 100. Based on the predicted and calculated result, while the work flow control unit 207 issues instructions to the use amount reservation processing unit 2061, it is possible to reserve the use amount of the user who is in charge of the process of each step in advance.

The preceding flow interruption request unit 2072 is operated as a part of the work flow control unit 207. The preceding flow interruption request unit 2072 notifies of another work flow of the client of a process order change request of the work flow when the user starts the work flow by using the MFP 100 if the following condition is satisfied. The condition is "the use amount calculated by the use amount calculation processing unit 2071 is larger than the usable amount stored in the upper limit amount storage unit 2041 but the predicted and calculated use amount of the work flow is satisfied if the unprocessed reserved use amount of the other work flow which has been already reserved is utilized". In other words, the condition refers to a case where the calculated use amount can be processed if the reserved use amount is diverted to this purpose.

In a case where the person who has reserved the execution of the work flow acknowledges the release of the reserved use amount, the work flow control unit 207 changes the process order of the work flow, thereby making it possible to process the work flow in first while the use amount of the work flow which requests the interruption is reserved.

A scanner control unit 208 controls the scanner unit 101 to drive the scanner unit 101 in accordance with the instruction from the CPU 201, reads the original on the original plate, and stores the read original in the memory 202.

A printer control unit 209 obtains the image data from the memory 202 in accordance with the instruction from the CPU 201, controls the printer units such as the laser exposure unit 102, the image formation unit 103, the fixing unit 104, and the sheet feed/conveyance unit 105, and prints the image on a recording sheet.

A transmission control unit 210 receives via the operation control unit 205 an operation instruction related to an application such as facsimile or electronic mail performed by the user. Then, the transmission control unit 210 or the like transmits the image data obtained from the memory 202 or the storage unit 204 to outside via the external interface 203 or receives the image data sent from outside and stores the image data in the storage unit 204.

An image processing unit 211 performs the image processing and a processing for improving the image quality instructed by the user via the operation control unit 205 or the like and the conversion of the resolution, the sheet size, and the like for the image data to be sent in accordance with the capacity of the destination during the facsimile transmission.

An internal bus 212 is used for mutually connecting the respect units. The transfer of the image data and transmission and reception of the instructions to the respective units and the set values are performed via the internal bus 212, for example.

Figure 3:
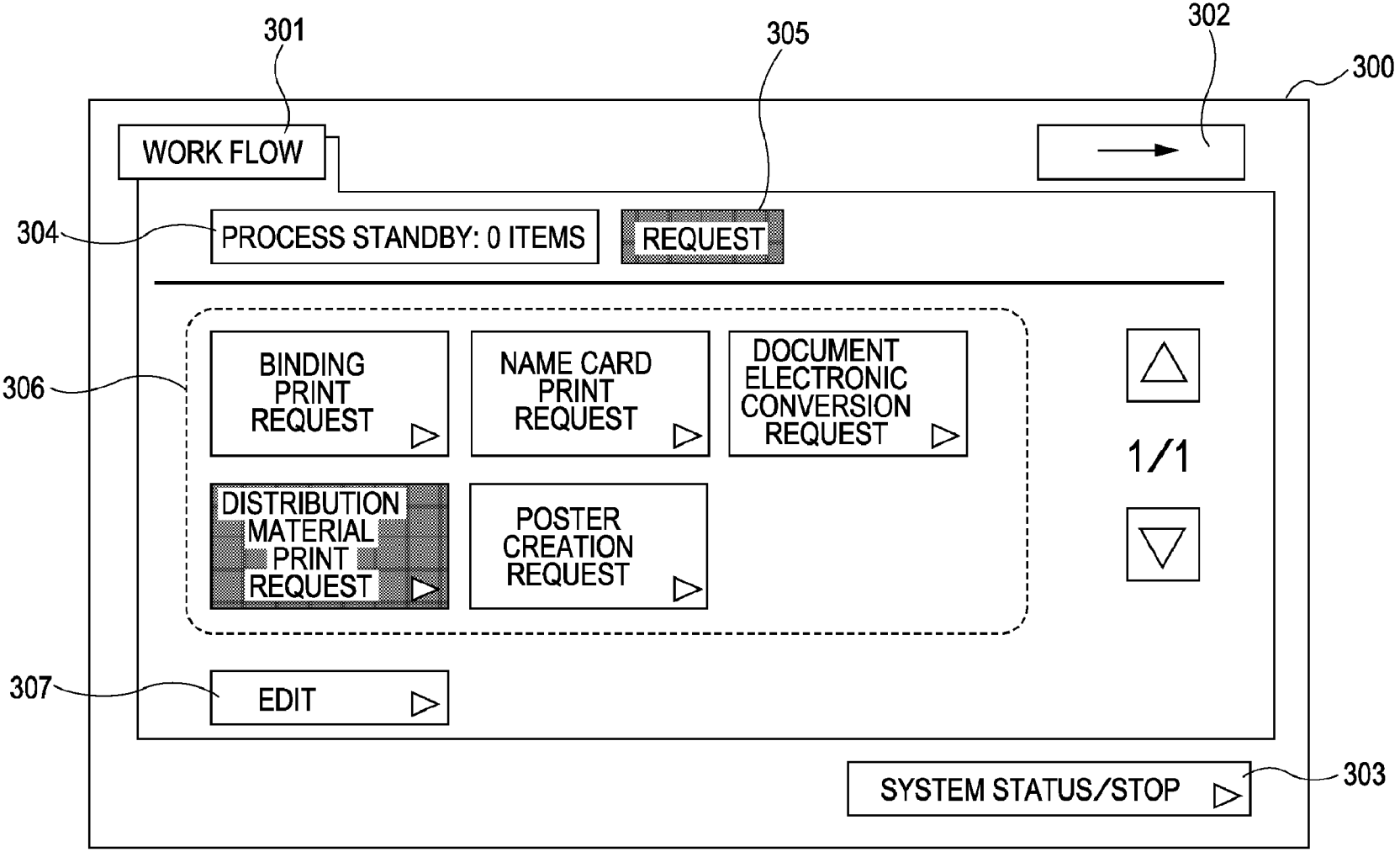
FIG. 3 illustrates an example of a "work flow list" screen displayed on a touch panel unit of the MFP, which is one of work flow execution screens controlled by an operation control unit in response to an operation of a user.

FIG. 3 illustrates an example of a "work flow list" screen 300 that is one of the work flow execution screens displayed on the touch panel unit of the MFP 100 and controlled by the operation control unit 205 in response to the operation of the user. The touch panel unit is composed of a LCD (Liquid Crystal Display) and a touch panel display which is made of a transparent electrode affixed on the LCD. The touch panel unit is previously programmed with such a process that when the transparent electrode at a part equivalent to a key displayed on the LCD is touched with a finger, the touch is detected and another operation screen is displayed.

A work flow tab 301 is a tab key for transiting the screen to the work flow operation screen by the user. A tab transition key 302 is a tab key for instructing the transition to the copy operation or the transmission operations such as facsimile or electronic mail by the user. A system monitor key 303 is a key for displaying the status or the situation of the MFP 100. While the user selects the respective tabs 301, 302, and 303, it is possible to transit the MFP 100 to the respective operation modes.

A process standby key 304 displays, when there is a work flow that should be processed which is requested from another user or the like with respect to the user who has logged in the MFP 100, a list of the work flows that are in standby to be processed. The process standby key 304 displays the number of the work flow in stand by.

A work flow request key 305 is a key for displaying a list of work flows that can be started by the user who has logged in the MFP 100.

Various work flow request start keys 306 are a plurality of keys to be displayed when the user presses the work flow request key 305. In the various work flow request start keys 306, the MFP 100 displays the list of work flows that can be started by the user. The user selects one of the keys from the displayed key list and presses the key. As a result, the MFP 100 starts the selected work flow. Examples of the work flow includes a binding print request, a name card print request, a document electronic conversion request, a distribution material print request, and a poster creation request. It is noted that an operation step is registered in the respective work flows as will be described in FIG. 4. Thus, when any one of the various work flow request start keys is selected to instruct the execution of the work flow, the work flow control unit 207 calls the operation step registered in the selected work flow and executes a process corresponding to the operation step.

An edit key 307 is a key for editing registration information of the various work flow request start keys 306 which are displayed when the user presses the work flow request key 305. When the user presses this button, an editing screen is displayed so that registration information such as display names of the respective work flows can be edited.

Figure 4:
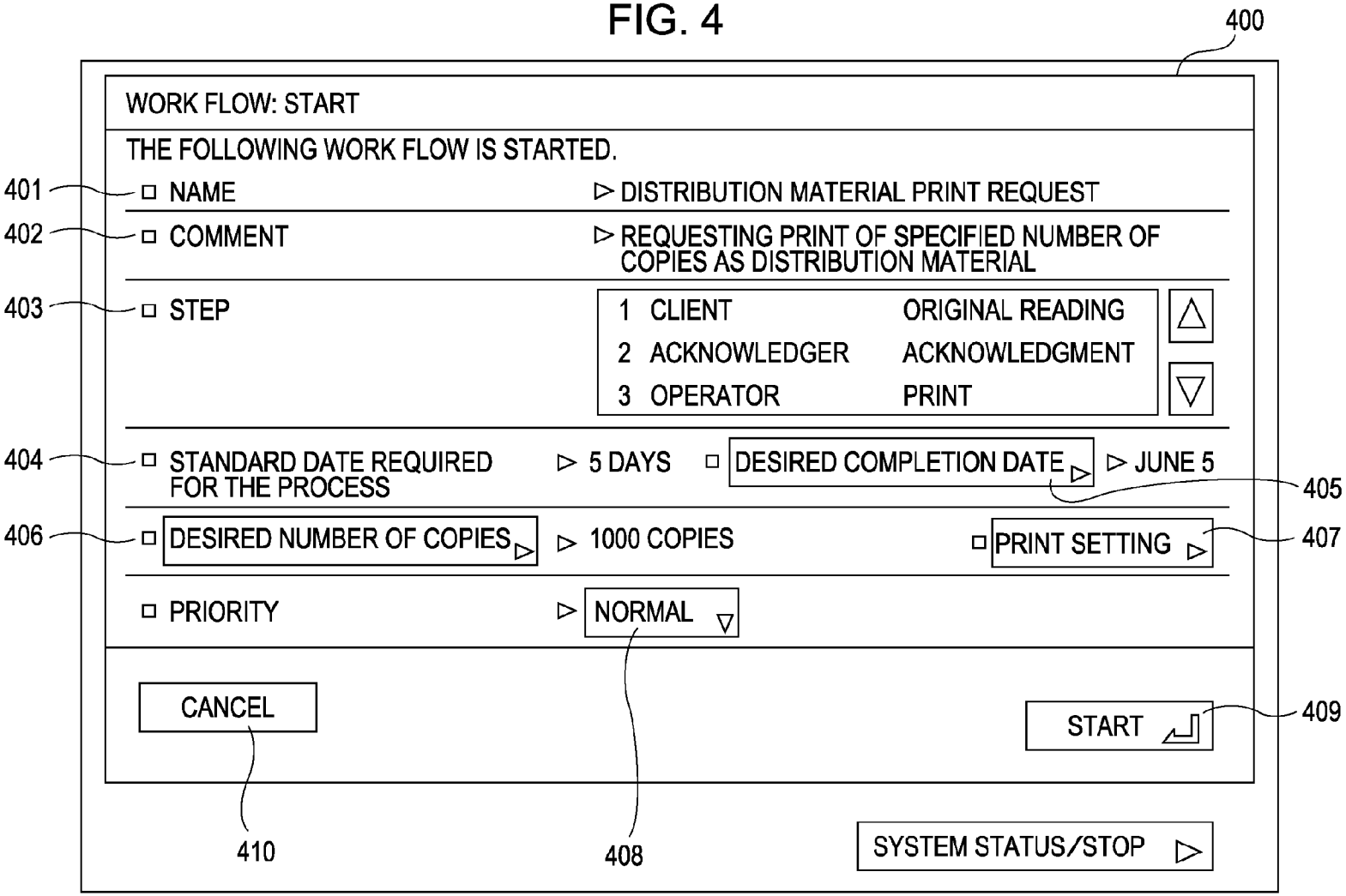
FIG. 4 illustrates an example of a "work flow start" screen displayed when the user selects one key among various work flow request start keys on the "work flow list" screen.

FIG. 4 illustrates an example of a "work flow start" screen 400 which is displayed when the user selects one of the various work flow request start keys 306 on the "work flow list" screen 300. The "work flow start" screen 400 is a screen for calculating the use amount for the respective functions required for each operation step included in the processing process of the work flow in accordance with a selection of a work flow request start key, before the work flow structured by the plurality of operation steps is executed. It is noted that FIG. 4 illustrates an example of a screen in a case where "distribution material print request" is selected. Also, the present specification describes a case while assuming that the plurality of operation steps included in the work flow is executed by a plurality of users, but the configuration is not limited to the above and the plurality of operation steps may be executed by a single user.

A name display field 401 is a field for displaying on the screen a display name of the selected work flow. A comment display field 402 is a field for displaying a comment about a context of the selected work flow by way of a text.

A process step confirmation field 403 is a field for displaying contexts of a plurality of steps structuring the selected work flow. An example illustrated herein corresponds to a work flow in which a request is issued by the client (in other words, a user itself who has logged in the MFP 100) by reading an original, the acknowledger (for example, a supervisor in the organization) acknowledges the request, and then the operator prints out the requested original. In other words, the distribution material print request work flow defines that the three operation steps of the original reading (client), the acknowledgement (acknowledger), and the print (operator) are processed in the stated order.

A standard process requiring date display field 404 is a field for displaying a standard date for which the work flow takes from the start to the completion as reference information. A desired completion date setting key 405 is a key for setting until when the work flow is desirably completed (year, month, and day).

A desired copy number setting key 406 is a key for setting a desired number of copies by the user. A print format setting key 407 is a key for setting a desired print format for finishing by the user. It is noted that in FIG. 4, the client sets the desired number of copies. Herein, the print format means, for example, color/monochrome, single/duplex, imposition, binding specification, and the like.

A priority setting key 408 is a key for setting a process priority of the work flow by the user. Herein, the process priority is, for example, priority/normal or the like.

A start key 409 is a key to be pressed when the start of the work flow of the content displayed on the "work flow start" screen 400 is requested by the user. When the start key 409 is pressed, in accordance with the control by the work flow control unit 207 or the like, an instruction for a necessary operation is issued to the user (for example, "please set the original on the original plate"). Then, the information set by the user on the "work flow start" screen 400 is obtained via the operation control unit 205 to calculate a use amount required for the user who is in charge of the process of the respective steps for executing the work flow in the use amount calculation processing unit 2071. Then, when a condition for starting the work flow is satisfied, the work flow control unit 207 starts the work flow. It is noted that examples of the condition for starting the work flow include whether a usable amount that can be executed by the users in charge of the process of the respective operation steps included in the selected work flow is larger than a use amount to be used in the respective operation steps.

A cancel key 410 is a key to be pressed by the user when the work flow displayed on the "work flow start" screen 400 is not started. When the cancel key 410 is pressed, the screen displayed on the touch panel unit is returned to the "work flow list" screen 300.

FIG. 5 illustrates an example of a work flow information storage table 500 that is a part of the work flow information storage unit 2042. The list of the work flows illustrated in the screen example of the "work flow list" screen 300 in FIG. 3 is stored in the work flow information storage table 500. In FIG. 5, as an example, the work flow of the "distribution material print request" illustrated in the "work flow start" screen 400 in FIG. 4 is represented in an XML (eXtensible Markup Language) format. However, the information of the work flow may be stored in a text format in a relational database or the like. The work flow control unit 207 refers to the work flow information storage table 500 mainly.

A work flow tag 501 represents a content of the work flow. A wfid attribute is an identifier for uniquely identifying the corresponding work flow. In the example of FIG. 5, an identifier "fid_002" is allocated. A caption attribute represents a name of the corresponding work flow. The display names of the various work flow request start keys 306 on the "work flow list" screen 300 in FIG. 3 and the names displayed in the name display field 401 of the "work flow start" screen 400 illustrated in FIG. 4 are cited from the caption attribute.

A standard attribute represents a standard period for which the completion of the corresponding work flow takes. The date displayed in the standard process requiring date display field 404 on the "work flow start" screen 400 is cited from the standard attribute. A limit attribute is a certain period set for the corresponding work flow. The limit attribute is used for the purpose of releasing the reserved use amount related to the remaining processes which are not processed even after a certain period elapses since the work flow is left untouched by the user. A step attribute represents the number of the operation steps which structure the corresponding work flow.

An activity tag 502 is a child tag of the work flow tag 501 and indicates the content of the individual operation steps which structure the work flow (or activity). An actid attribute is an identifier for uniquely identifying the corresponding operation step. In the example of FIG. 5, an identifier "aid_req_001" is allocated. A role attribute represents an authority with which the corresponding operation step can be executed. The work flow control unit 207 determines in response to the role attribute whether, the user or the system can use or not in response to the authority allocated in the authentication system. For example, the role attribute in the second step in the distribution material print request of FIG. 4 describes "superior". In other words, the work flow control unit 207 allows the acknowledgment process execution only when the user provided with the user authority "superior" acknowledges.

The caption attribute represents a name of the corresponding operation step. The name displayed in the process step confirmation field 403 of the "work flow start" screen 400 is cited from the caption attribute. A seq attribute represents an order of processes for the plurality of operation steps which structure the corresponding work flow. An action tag is a child tag of the activity tag 502 and defines a function type (type attribute) such as scan or send which represents the process content of the corresponding operation step and a coefficient for calculating the use amount such as the counter (counter_coefficient).

FIG. 6 illustrates an example of an upper limit use amount storage table 600 that is a part of the upper limit amount storage unit 2041. The upper limit use amount storage table 600 is mainly updated/referred to by the use amount control unit 206, the use amount reservation processing unit 2061, and the use amount reservation carry-over processing unit 2062. The upper limit use amount storage table 600 is used for setting an upper limit value such as the number of sheets that can be used in a certain period of time for the user or the group for limitation. As illustrated in FIG. 6, the upper limit amount storage unit 2041 manages the upper limit value of the use amount for each of the function types in the plurality of steps included in the work flow.

A user ID 601 is an identifier for uniquely identifying the user or the group. The identifier is identified by the authentication system introduced into the MFP 100 by using information input when the user or the group performs the logging in or the like to utilize the MFP 100.

A function type 602 represents a function of a target whose use amount is counted. Examples of the function type include the printing (print), the scan (scan), the transmission (send), the disk use amount (disk), the use time (time), etc.

A switching date and time 603 indicates a switching date and time between the current counting period and the next counting period in a case where a certain period of time for counting the use amount is set. In other words, the currently calculated used amount is reset at the switching date and time. A new registration to the upper limit use amount storage table 600 is performed through an operation of the user having an administrator authority or the like. At that time, a new certain period of time for the upper limit value management, in other words, a date and time for switching the counting period to the next upper limit value management period is set as the switching date and time 603.

The upper limit use amount storage table 600 becomes unique in combination with the user ID 601, the function type 602, and the switching date and time 603, and each use amount information is stored therein.

An upper limit use amount 604 is a numeric value for setting the upper limit value in which the respective users can use the corresponding function in a certain period of time, and its unit varies depending on the functions. As an example, the print counter of 100000, the disk capacity of 8192 MB, and the like are used.

A used amount 605 is a numeric value for representing the use amount with which the respective users actually use the relevant function in the relevant period. When this numeric value reaches the numeric value of the upper limit use amount 604, the user is restricted to use the relevant function until the next switching date and time 603.

Reserved use amount information 606 represents the number of reservations in which the required value is ensured in advance so that the relevant user can use the relevant function during the relevant period before actually used. The reserved use amount information 606 can hold a plurality of combinations of reservation job IDs 6061 and reserved use amounts 6062, the total of the plurality of reserved use amounts is set as the total reserved use amount. The reservation job ID 6061 indicates a job ID of the work flow that performs the use amount reservation. For example, "f350/3" refers to the third step that structures a flow job ID "f350". The reserved use amount 6062 is a use amount reserved in the relevant reservation job ID. For example, in FIG. 6, the user ID "kato" indicates that "100000" sheets are set as the upper limit value for the "print" function and the print of "85200" sheets has been executed during the current certain period of time. Furthermore, in the work flow "f350/3", such a reservation is made that the print of "10000" sheets and in the work flow "f352/3" the print of "250" will be performed. With the above-described configuration, the user ID "kato" can execute the print of "4550" sheets calculated through "100000 (the upper limit use amount)−[85200 (the used amount)+(10000+250 (the reserved use amount))] during the current certain period.

In the MFP 100, when the user attempts to start the work flow structured by the plurality of operation steps through the operations of the plurality of users, the following process is performed. The work flow control unit 207 uses the use amount calculation processing unit 2071 to the use amount for the respective functions necessary for each user included in the processing process of the work flow. Then, the use amount reservation processing unit 2061 adds the calculated use amount to the relevant reserved use amount 606 (the reservation job ID 6061 and the reserved use amount 6062) for registration.

The current usable amount of the function type for the user during the relevant period is calculated in the following calculation expression: "the usable amount=the upper limit use amount 604−(the used amount 605+the total reserved use amount)".

When the usable amount is 0 or is not enough to the use amount necessary for the operation step to be executed, the job execution is limited.

FIG. 7 illustrates an example of a work flow execution status management table 700 that is a part of the work flow status storage unit 2043. The work flow control unit 207 performs registration/update/reference with respect to the work flow execution status management table 700. The work flow execution status management table 700 manages the status of the execution of the work flow which is structured by a plurality of operation steps performed by a plurality of users.

A flow job ID 701 is an identifier for uniquely identifying a work flow issued when the user starts the work flow. The flow job ID 701 is stored for tying with the reservation job ID 6061 described in FIG. 6 and a job history management table 800 that will be described later.

In a start date and time 702, a date and time when the corresponding work flow was started. In a start user ID 703, an ID of the user or the group starting the relevant work flow is stored. Similarly to the user ID 601 in FIG. 6, this identifier is identified by the authentication system introduced into the MFP 100.

In a flow ID 704, an identifier for identifying the relevant work flow is stored. The identifier stored in the flow ID 704 is an identifier stored while citing the ID that is stored in the wfid attribute of the work flow tag of the work flow information storage table 500 in FIG. 5 by the work flow control unit 207.

A desired completion date and time 705 is set through an operation of the desired completion date setting key 405 in FIG. 4 by the requesting user when the work flow is started, for example. In the desired completion date and time 705, a desired completion date and time until the final step of the work flow will be completed.

In a current status 706, data indicating that until which operation step in the work flow structured by the plurality of operation steps has been processed is stored. For example, "3/3" indicates that until the third operation step has been processed in the work flow structured three operation steps.

In a completed status 707, a status in which the relevant work flow has been completed or is still being processed, and if the relevant work flow has been completed, the process is normally completed or cancelled, for example.

In a priority 708, a process priority with respect to a work flow which is set while the requesting user operates the priority setting key 408 on the "work flow start" screen 400 in FIG. 4 when the work flow is started, for example. Herein, a work flow whose priority is set as "high" is executed in priority to a work flow whose priority is set as "normal" or a work flow whose priority is set as "low". On the other hand, the work flow whose priority is set as "normal" is executed in priority to the work flow whose priority is set as "low".

In a completion deadline date and time 709, a date and time obtained by adding the start date and time 702 with the certain period of time stored in the limit attribute of the work flow tag in the work flow information storage table 500 of FIG. 5 is stored. When the work flow is kept unprocessed by the user, for example, the completion deadline date and time 709 is used for the purpose of releasing the reserved use amount related to the remaining operation step unprocessed even after the date and time of the completion deadline date and time 709. For example, in FIG. 7, such a status is stored that a work flow of a flow job ID "f_351" among the three operation steps is the second operation step. In this status, if the process is not executed by the completion deadline, the reserved capacity for the third operation step is released and used for another work flow.

There is a case where it is desired that the general operation step which is not included in the work flow be executed in priority to the already reserved operation step of the work flow. For processing the high priority job is processed in priority to another reservation job, in order to set the use amount within the upper limit use amount 604 of the upper limit use amount storage table 600, the reserved use amount 6062 related to the other reservation job needs to be released. When the use amount control unit 206 determines in this way, the following process is processed.

First, the use amount control unit 206 searches the contents of the high priority job (the user ID 601, the function type 602, and the switching date and time 603) for other related reservation job data. The use amount control unit 206 determines whether the use amount necessary for executing the high priority job can be processed or not. For example, the user with the user ID "1" can print 50 pages per week, the print of 30 pages is currently processed, and the print of 15 pages is reserved. In this case, the user with the user ID "1" can perform the print of the remaining 5 pages. In this status, when the high priority job in which the print process of 20 pages needs to be executed is input, if the use amount control unit 206 releases the print of the reserved 15 pages, the use amount control unit 206 determines that the high priority job can be processed.

In this way, when it is determined that the high priority job can be processed while the reservation job in the unprocessed status is cancelled by the use amount control unit 206, the reservation job ID 6061 of the reservation job is obtained.

The use amount control unit 206 uses the obtained reservation job ID as a key to search the work flow execution status management table 700 to obtain the priority 708 and the completion deadline date and time 709. Then, the use amount control unit 206 first compares the priority of the high priority job with the priority of the reservation job.

When the priority of the reservation job is equal to or higher than the priority of the high priority job, the interruption process is not permitted, but the priority of the reservation job is lower than the priority of the high priority job, the interruption process is permitted.

When the interruption process is permitted, the use amount control unit 206 determines whether the completion deadline date and time of the obtained reservation job is set before the switching date and time 603 of the relevant reservation job or not.

In a case where the completion deadline date and time of the obtained reservation job is set before the switching date and time 603 of the relevant reservation job, the use amount reservation processing unit 2061 releases the reserved use amount information 606 reserved in the upper limit use amount storage table 600. This is because when the reservation job is completed before the switching date and time, by releasing the relevant reservation job, it is possible to ensure the use amount for processing the high priority job before the switching date and time.

In this case, the execution of the work flow including the reservation job may be limited due to the restriction of the upper limit use amount 604.

On the other hand, a case is assumed that the completion deadline of the obtained reservation job is set after the switching date and time 603 of the relating upper limit use amount storage table 600. In this case, the use amount reservation carry-over processing unit 2062 repeats the reserved use amount information 606 of the upper limit use amount storage table 600 for the data during a period after the switching date and time 603 where the user ID 601 and the function type 602 are the same. This is for the job belonging to the work flow included in the reservation job.

By performing such processes, even when the high priority job interrupts the process, the work flow including the reservation job can ensure the reserved use amount as well while the completion deadline date and time is satisfied.

FIG. 8 illustrates an example of the job history management table 800 that is a part of a job history storage unit 2044. The job history management table 800 is mainly registered/referred to by the use amount control unit 206. The job history management table 800 stores a history of an operation jobs including not only the individual operation step that structures the work flow but also other processes.

A job ID 801 is an identifier uniquely issued when a job is executed in the MFP 100.

A function type 802 represents a type of the job. Examples of the job type include the printing (print), the scan (scan), the transmission (send), and the copy (copy).

A result 803 represents a process result of the job. Examples of the process result include the normal completion (OK), the stop (STOP), and the error (ERR).

A job name 804 represents a name of the image data or the document data that becomes a job target. An address 805 represents an address of the destination when the function type 802 is the transmission (send). An electronic mail address, a telephone number, and a registration name registered in the MFP 100 are stored therein.

In a start time 806, a time when the relevant job process is started is stored. In a use amount 807, a use amount (counter value) used for the relevant job process is stored.

A user ID 808 is an identifier uniquely identifying a user or a group executing the relevant job process. Similarly to the user ID 601 of FIG. 6, the user ID 808 is the identifier identified by the authentication system introduced into the MFP 100.

A flow job ID 809 is an identifier uniquely identifying a work flow issued when the user started the work flow. The flow job ID 809 is stored for tying with the flow job ID 701 of FIG. 7 and the reservation job ID 6061 of FIG. 6.

When the work flow structured by the plurality of operation steps is executed through the operations of the plurality of users, if the job process included in the work flow is performed, the content of the job process is added to the job history management table 800 by the use amount control unit 206. At that time, the actually used counter value or the like is recorded in the use amount 807. Then, the work flow control unit 207 uses the flow job ID 809 as a key to search the work flow execution status management table 700 to update the statuses of the related work flows (the current status 706 and the completed status 707).

Also, the work flow control unit 207 searches the upper limit use amount storage table 600 on the basis of the function type 802, the start time 806, the user ID 808, the flow job ID 809, the flow ID 704, and the like of the relevant job. Then, while the work flow control unit 207 adds the used amount 605 of the searched data, the use amount reservation processing unit 2061 clears the reservation job information 606 of the completed job.

Figure 9A:
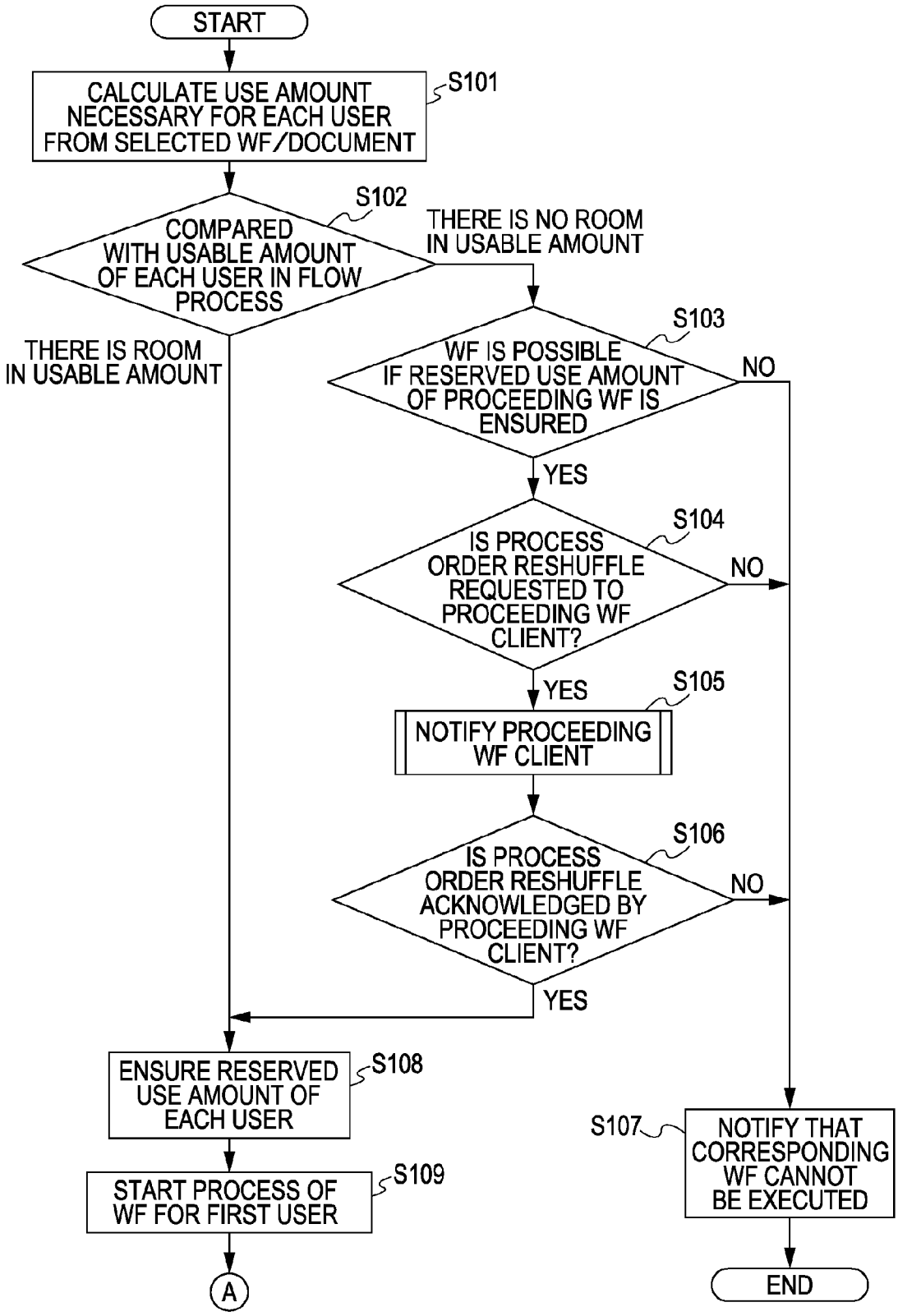
FIGS. 9A and 9B are flowcharts illustrating a series of processes in a control method for executing the work flow.
Figure 9B:
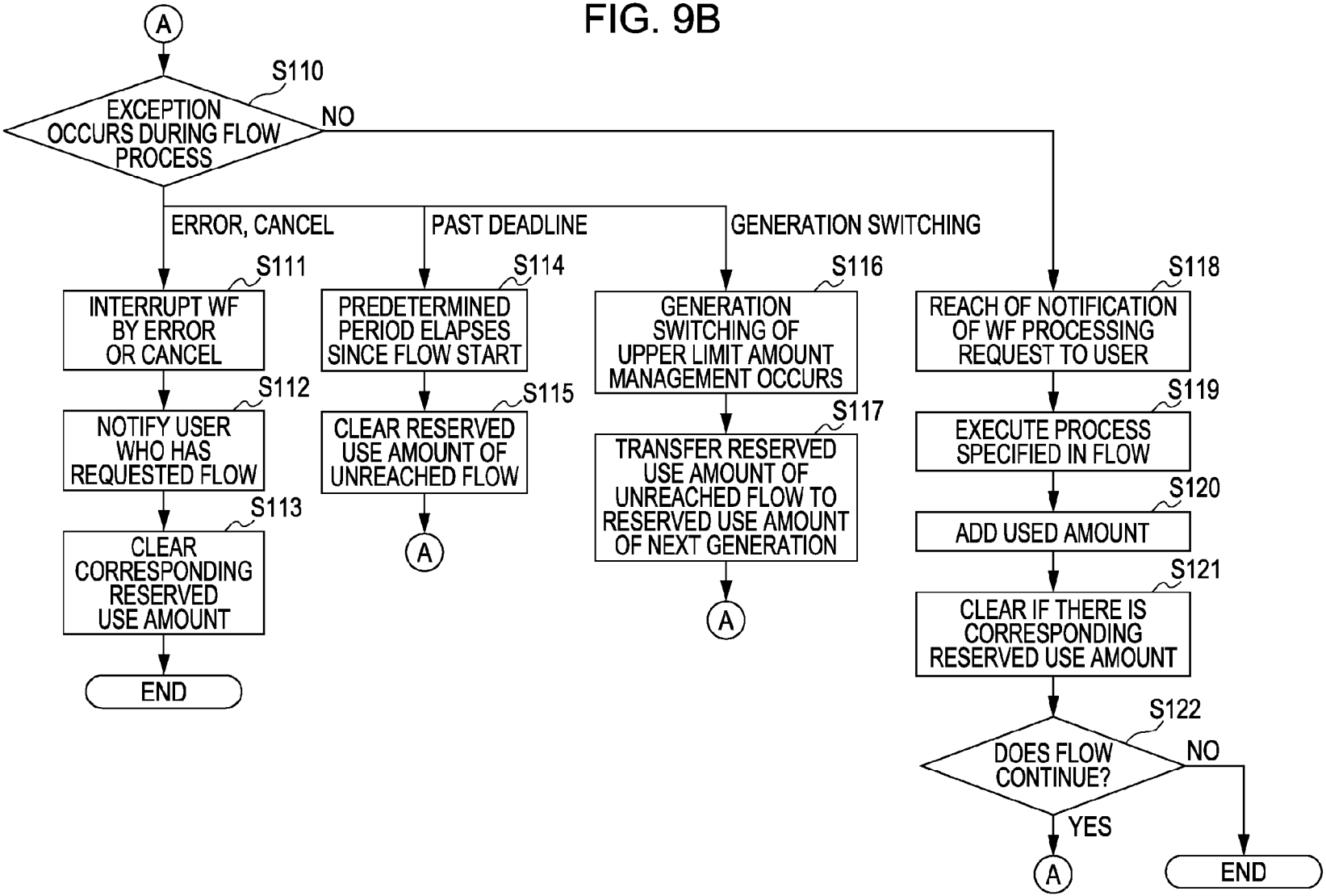

With reference to FIGS. 9A and 9B, a description will be provided of a process for executing the work flow in the MFP 100 before the work flow structured by a plurality of operation steps performed by a plurality of users is executed and after the use amount for the respective functions necessary for each user included in the work flow is predicted and calculated. It is noted that the respective steps in FIGS. 9A and 9B are executed by the CPU 201 of the MFP 100.

FIGS. 9A and 9B are flowcharts illustrating a series of processes in a control method for executing the work flow. First, the "work flow start" screen 400 in FIG. 4 is displayed in response to the instruction from the user on the touch panel unit of the MFP 100, the setting is performed, and the "start" key is pressed. Then, in Step S101, the MFP control unit 200 first identifies the target work flow, the number of copies, the print format, and the original document. Then, on the basis of the information identified by the use amount calculation processing unit 2071, the use amount is calculated such as the counter value necessary for processing the requested process information for each user who should process the respect steps included in the procedure of the process target work flow and for each function type that is the operation content of the step. It is noted that the process information is a work that should be processed by using the selected work flow. For example, the number of originals that should be output by the process information or should be read is set as a value input through the screen of FIG. 4.

To be more specific, first, the user A selects the "distribution material print request" work flow displayed on the touch panel unit of the MFP 100 from the "work flow list" screen 300. Subsequently, the user A uses the "work flow start" screen 400 to specify that the desired completion date is a date on 10 days after, the desired number of copies is 1000, the print settings are A4, color, and duplex printing, the priority is normal, the number of original pages is 10, and the start key 409 is pressed to start the work flow. It is noted that at this time, the original pages may be taken in through the scan process. Then, the work flow control unit 207 obtains the work flow processing process on the basis of the "distribution material print request" work flow (wfid="fid_002") information obtained from the work flow information memory table 500 and the information from the authentication system. As a result, for example, it is found out that the following operation step is included in the work flow. "The user A" performs the "original scan" and "send" as "application". "The supervisor B" of the user A performs "acknowledgement" to carry out "send". "The operator C" performs the "print".

The use amount calculation processing unit 2071 can previously calculate the necessary use amount in the unit of operator who performs the respective operations steps as follows on the basis of the process content of the operation step included in the selected work flow and the set number of copies and the set format. The user A: scan counter 10, send counter 1, and disk capacity 32 MB. The supervisor B: send counter 1. The operator C: print counter: 10000, and use time: 30 minutes.

In Step S102, the use amount reservation processing unit 2061 compares the necessary use amount calculated in S101 with the usable amount during this period of the respective operation steps included in the procedure of the work flow to check whether the required use amount is within the usable amount. The use amount reservation processing unit 2061 searches the upper limit use amount memory table 600 for data related to the respective operation steps included in the work flow on the basis of the user ID 601, the function type 602, and the switching date and time 603.

The use amount reservation processing unit 2061 uses "the usable amount=the upper limit use amount 604−(the used amount 605+the total reserved use amount)" which is a calculation expression described in the description of FIG. 6 to calculate the usable amount and compare the usable amount with the necessary use amount calculated in Step S101. Then, in a case where the necessary use amount of the respective operation steps included in the work flow is equal to or lower than the usable amount, it is determined that there is a room until the upper limit value and the process advances to Step S108. On the other hand, when at least the necessary use amount of one of the operation steps included in the work flow is larger than the usable amount, there is no room until the upper limit value and the process advances to Step S103.

In S103, the use amount reservation processing unit 2061 determines whether if the value of the reserved use amount 6062 for the user who is in charge of the step in which it is determined in the process in S102 that the necessary use amount is larger than the usable amount is added to the usable amount, the value satisfies the necessary use amount. In other words, it is determined whether the process of the operation step that is the current process target can be processed if the use amount reserved for another work flow is cancelled. When it is determined in the determination process in S103 that a necessary use amount of the operation step that is the current process target satisfies the necessary use amount if the value of the reserved use amount 6062 of the preceding work flow is diverted for this purpose to be added to the usable amount, the process advances to Step S104. On the other hand, regarding the operation step whose the necessary use amount is larger than the usable amount among the all operation steps in the work flow, when the necessary use amount of the corresponding operation step is larger than the usable amount even after the diversion of the reserved use amount, the process advances to Step S107.

In Step S104, first, the work flow control unit 207 receives from the use amount reservation processing unit 2061, the reservation job ID 6061 (for example, "f350/3") of the operation step of a significant preceding work flow to which the reserved use amount 6062 is diverted. It is noted that the operation step of the significant preceding work flow to which the reserved use amount is diverted refers to a step in which the usable amount of the operation step where it is determined in S102 that there is no room to room until the upper limit value is increased by releasing the reservation of the preceding operation step. As an example, such a case is considered that the operation step of the color print cannot be executed due to shortage of the usable amount and the count value of the color print and the count value of the monochrome print are independently managed. Herein, in the case of a simple print step, even if the reserved use amount of the work flow having the operation step for performing the monochrome print is released, the usable amount of the monochrome print is increased, but the usable amount of the color print is not increased. On the other hand, when the reserved use amount of the work flow having the operation step for performing the color print is released, the usable amount of the color print is increased, and therefore the shortage of the usable amount is eliminated. Thus, in this case, the work flow having the operation step for performing the color print is a significant preceding work flow.

S103 and S104 will be described in detail. The work flow control unit 207 identifies the function type from the operation content in the operation step in which it is determined in S102 that the necessary use amount is higher than the usable amount. As described above in FIG. 6, in the upper limit storage table, the reservation work flow and the reserved use amount are managed while being in association with each other for each user. Thus, the work flow control unit 207 refers to the upper limit storage table of FIG. 6, and determines whether regarding the operator for the operation step in which it is determined in S102 that the necessary use amount is higher than the usable amount, there is a work flow reserving the identified function type or not. Then, when the same function type is reserved as the identified function type, the use amount reservation processing unit 2061 notifies the work flow control unit 207 of a reservation job ID of the identified work flow.

Subsequently, the work flow control unit 207 uses the flow job included in the reservation job ID 6061 as a key to search the work flow execution status management table 700. Then, the work flow control unit 207 identifies the start user ID 703 of the work flow to which the reserved use amount is diverted.

Then, the work flow control unit 207 displays on the touch panel unit is requested to the user requesting the start of the present work flow "Is an approval for a process order change applied to the client having the preceding reservation?". When it is determined that the user has selected "Yes", the process advances to Step S105 and when it is determined that the user has selected "No", the process advances to Step S107.

In Step S105, the work flow control unit 207 notifies the user having the obtained start user ID 703 in Step S104 of the reshuffling request of the process order of the work flows from the client for the subsequent work flow. A detail description of a method of performing acknowledgement/refusal by the user who has requested the preceding work flow who has received the notification will be omitted herein. It is noted that according to an example of the notification method, if a storage unit of the MFP stores a mail address of the respective users, a mail address of the identified user is specified and the user is asked whether the process order may be changed or not.

In Step S106, the work flow control unit 207 determines whether the user who has requested the preceding work flow acknowledges the work flow process order reshuffle or not. In a case where the user who has requested the preceding work flow acknowledges the work flow process order reshuffle, the use amount reservation processing unit 2061 instructed from the work flow control unit 207 performs the following process and the process advances to Step S108. In other words, the use amount reservation processing unit 2061 releases the reserved use amount 6062 of the reservation job ID 6061 to be used in the preceding work flow step picked up in Step S103 and the process advances to Step S108.

On the other hand, in a case where the user who has requested the preceding work flow refuses the work flow process order reshuffle request, the process advances to Step S107.

In Step S107, the work flow control unit 207 notifies the user who has requested the present work flow through a screen display on the touch panel unit, an electronic mail, or the like that "The use amount reaches the upper limit, and please wait the work flow request until a date ○○/○○.". As a result, the series of the processes for the control method illustrated in FIGS. 9A and 9B are completed. This notification is, for example, cannot be performed already by the used amount and the reserved use amount in the current period but can be executed if these use amounts are reset, and thus the work flow control unit 207 notifies the switching date and time when this reset process will be executed.

In Step S108, the work flow control unit 207 generates a flow job ID that uniquely identifies the present work flow and newly adds the present information of the work flow to the work flow execution status management table 700. At that time, the work flow control unit 207 adds the certain period of time set in the limit attribute of the relevant work flow tag 501 of the work flow information storage table 500 to the start date and time 702 of the work flow execution status management table 700. The work flow control unit 207 performs the addition in this way and sets the calculated date and time as the completion deadline date and time 709.

The use amount reservation processing unit 2061 adds and registers the user derived in Step S101 who should perform the operation step included in the process in the work flow and the use amount for each function type of the relevant operation step as the reserved use amount information 606 of the upper limit use amount storage table 600. Herein, the reserved use amount information 606 added to be registered is a combination of the reservation job ID 6061 and the reserved use amount 6062.

With this process, it is possible to reserve the use amount for each function of the plurality of functions for the plurality of users included in the work flow before the present execution of the work flow.

In this way, in Step S109, the work flow control unit 207 starts the actual job process in the present work flow.

In Step S110, the work flow control unit 207 determines whether an exception is generated in the flow process or not. Branches in Step S110 relate to the exception generation in the present processing process of the work flow. It is noted that the exception expected in the present application refers to a status where the operation step included in the work flow cannot be executed normally. The exception expected in the present application refers to an error in the flow process, cancellation, past deadline, and counting period switching, but the exception is not limited to the above.

When the process is performed normally (S110—No), in the work flow control unit 207, the process advances to a process in Step S118. Regarding a type of the execution, when the user operates the MFP 100 or the like to select the cancellation or refusal on the execution of the present work flow process, in a case where the error is generated and the work flow process cannot be continued, the process of the work flow control unit 207 advances to a process in Step S111. Than, regarding a type of the execution, when the user who should process the present work flow forgets to perform the process, in a case where the job process is kept unprocessed and the time is past the deadline, the process of the work flow control unit 207 advances to a process in Step S114. On the other hand, regarding a type of the execution, when the switching date and time of the counting period of the upper limit value management related to the use amount is exceeded in the process in the present work flow, the process of the work flow control unit 207 advances to a process in Step S116.

In Step S111, the MFP control unit 200 is notified of the cancellation of the currently executed present work flow via the operation control unit 205, the external interface 203, or the like from the user, the work flow control unit 207 performs the interruption process on the work flow. Also in a case where the MFP 200 determines that it is difficult to continue the present work flow cannot any longer due to a system trouble in addition to the cancellation or the refusal by the user, the work flow control unit 207 performs the work flow interruption process.

In Step S112, the work flow control unit 207 searches the work flow execution status management table 700 for obtaining the start user ID 703 in the present work flow. Subsequently, the work flow control unit 207 notifies the starting user of the interruption of the present work flow due to the cancellation or the refusal (or the error) etc.

In Step S113, the use amount reservation processing unit 2061 instructed from the work flow control unit 207 releases the respective steps included in the present work flow registered in the upper limit use amount storage table 600. In addition, when the reserved use amount 6062 tied with the reservation job ID 6061 exists, the use amount reservation processing unit 2061 instructed from the work flow control unit 207 also releases the reserved use amount. With this release, the use amount control unit increases the usable amount by the released use amount.

Subsequently, the work flow control unit 207 updates the statuses of the present work flow in the work flow execution status management table 700 and the completed status 707 of data tied with the flow job ID 701 into the cancellation (or the error). As a result, the plurality of processes in the control method are completed.

A process in Step S114 is executed in a case where the job process is kept unprocessed as the user who should perform the present work flow forgets to perform the process. For example, this case applies when the supervisor B of the user A forgets to perform the acknowledgement process for the present work flow and keeps the process unprocessed as exemplified in Step S101.

In Step S114, the work flow control unit 207 detects that the present work flow is not completed even after the certain period of time by monitoring the completion deadline date and time 709 in the work flow execution status management table 700 set in Step S108.

In Step S115, the use amount reservation processing unit 2061 instructed by the work flow control unit 207 releases the unprocessed operation step included in the present work flow registered in the upper limit use amount storage table 600. In addition, the use amount reservation processing unit 2061 instructed by the work flow control unit 207 also releases the reserved use amount when the reserved use amount 6062 tied with the reservation job ID 6061 exists, and the process advances to Step S110. In other words, in this case, the reserved use amount is not ensured in the unprocessed present work flow. Instead, the usable amount can be increased for another job.

A process in Step S116 is executed in a case where in the present processing process of the work flow, the switching date and time of the counting period in the upper limit value management regarding the use amount is exceeded. For example, this case is applied when the month is changed to July during the process of the work flow which was started in June while the upper limit value management is performed on a monthly basis. Through the operation of the user having the administrator authority or the like, when the use amount control unit 206 performs a new registration in the upper limit use amount storage table 600, the certain period of time of the upper limit value management, in other words, the switching date and time of the counting period 603 to the next upper limit value management period is set.

In Step S116, the use amount reservation carry-over processing unit 2062 monitors the switching date and time of the counting period and thus detects the switching of the counting period.

In Step S117, the use amount reservation carry-over processing unit 2062 searches the upper limit use amount storage table 600 at the time of the switching date and time 603. Then, the use amount reservation carry-over processing unit 2062 changes the data into data in which reservation information registered in the reserved use amount information 606 before the switching date and time the user ID 601 and the function type 602 and the same and the switching date and time 603 is the next period and then the process advances to Step S110.

In other words, for example, also when the month is changed from June to July while the operator C exemplified in Step S101 waits for the process of the present work flow, the reserved use amount for the operator C which is reserved in June is automatically changed as the reserved use amount for July. It is noted that processes in Steps S116 and S117 will be described in detail with reference to a flowchart in FIG. 10.

It is noted that regarding the change of the reserved use amount in the unprocessed operation step included in the work flow as the reserved use amount in the next counting period may be performed when it becomes obvious that the execution of the job process is after the switching date and time.

When the work flow process is normally advanced, in Step S118, a process request arrives at the user who executes the operation step in the course of the present work flow. For example, a "print" request arrives at "the operator C" exemplified in Step S101 by way of an electronic mail or the like. When the user opens the "work flow list" screen 300 displayed on the touch panel unit of the MFP 100 exemplified in FIG. 3, for example, "process standby: 1 item" is displayed in the process standby key 304, and it is possible to understand that there is a job in the work flow that should be processed by the operator itself.

In Step S119, when the user presses the process standby key 304 on the "work flow list" screen 300, the content of the job in the work flow that should be processed is displayed (not illustrated). For example, in the case of "the operator C" exemplified in Step S101, such information is notified from the client "the user A" that the number of copies is 1000, the print setting is A4, color, and duplex printing, and the priority is normal. In addition, such information is notified that 10 pages of the scan original scanned and saved in the storage unit 204 within the MFP 100 are printed. In accordance with this instruction, while the user operates the touch panel unit, the use amount control unit 206 receives the instruction, and the print process is executed by the image processing unit 211 and the printer control unit 209. At this time, each setting value information is also notified, and therefore these pieces of setting value information may be set with respect to the MFP.

In Step S120, the use amount control unit 206 adds and registers the content of the executed operation step in the job history management table 800 exemplified in FIG. 8 (and adds and registers the actually used counter value etc. are in the use amount 807).

Also, the work flow control unit 207 uses the flow job ID 809 of the relevant job added to the job history management table 800 as a key to search the work flow execution status management table 700 to update the current status 706 of the related work flow. Then, the work flow control unit 207 searches the upper limit use amount storage table 600 on the basis of the function type 802, the start time 806, the user ID 808, the flow job ID 809, the flow ID 704, and the like of the relevant job added to the job history management table 800. After that, the work flow control unit 207 adds the used amount 605 of the related data.

In Step S121, the use amount reservation processing unit 2061 clears the relevant reservation job ID 6061 and the reserved use amount 6062 if the data to which the used amount 605 is added is registered in Step S120 with the reservation job information 606 where the process has been completed.

In Step S122, the work flow control unit 207 determines whether there is an operation step continuing after the present work flow or not. When there is a job continuing after the present work flow, the process advances to Step S110. The work flow control unit 207 notifies a subsequent user, for example, of a process request. On the other hand, when the job whose process is just ended is the last in the present work flow, the work flow control unit 207 performs a completion process. In other words, the work flow control unit 207 updates the completion status in the data of the completed status 707 tied with the flow job ID 701 of the work flow execution status management table 700 (for example, "ok" is set in a normal case). As a result, the series of processes for the control method are completed.

In other words, the work flow control unit 207 permits the process related to the work flow when the use amount for the respective operation steps included in the target work flow is reserved.

As described above, according to the present embodiment, at the work flow start time point, the use amount is calculated for each user who executes the process of the respective operation steps included in the work flow for each function and it is possible to ensure the use amount as the reserved use amount.

As a result, it is possible to prevent the process from being unprocessed while at the starting time, there is a room until the upper limit value but by the time the work flow process actually arrives the user, the user executes another job and thus the value is close to the upper limit value so that the use amount is short for performing the work flow process. Thus, it is possible to smoothly carry forward the work flow.

Furthermore, when the process is kept unprocessed for a long time as the user included in the process in the work flow did not check or the like, after the elapse of the certain period of time, the previously reserved use amount is released regarding the remaining job process in the uncompleted work flow. With this configuration, it is possible to avoid an unnecessary limitation on the usable amount of another job.

Furthermore, the predicted and calculated use amount of the work flow may be satisfied in some cases if the use amount calculated for the user included the processing process of the work flow before the work flow execution is larger than the usable amount and also the already reserved use amount of another uncompleted work flow is utilized. In this case, the client for the other work flow is notified of the request on the process order change for the work flow. Then, when the acknowledgement is made by the notified client, the reshuffle of the reserved use amount is performed and the change for the process order in the work flow is easily executed.

Figure 10:
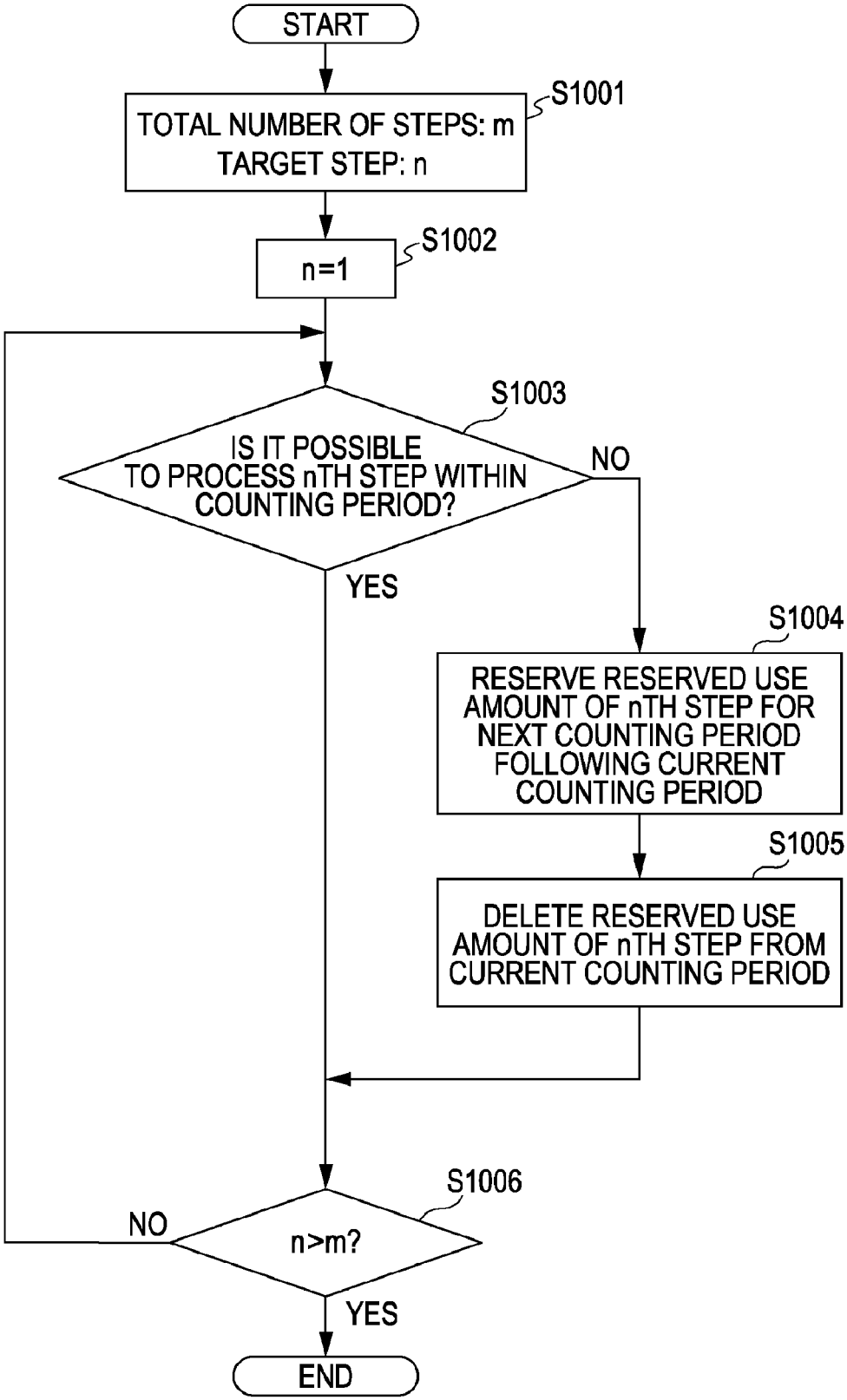
FIG. 10 is a flowchart illustrating a process in a method of setting a reserved use amount which is executed for changing a counting period.

Subsequently, in accordance with the change in the counting period, a case where the reserved use amount is shifted from the current counting period to the next counting period will be described with reference to a flowchart in FIG. 10.

The work flow control unit 207 manages the number of the operation steps included in the currently targeted work flow as m and the determination target operation step as n (S1001).

The work flow control unit 207 initializes the currently targeted operation step (S1002) and determines whether the currently targeted nth operation step can be processed within the counting period or not (S1003). With this process, the work flow control unit 207 identifies, in the step included in a plurality of the operation steps structuring the work flow, the operation step whose process is not completed within the counting period of the management of the upper limit value regarding the use amount.

The work flow control unit 207 calculates a time until the next counting period based on the current date and time and the next switching date and time. Then, when the process in the determination target operation step is completed, S1003—Yes is determined and the process advances to S1006. On the other hand, when the process in the determination target operation step is not completed, and it is determined that the process in the operation step is not completed within the time limit by the next counting period, S1003—No is determined. Herein, a method of calculating a process time related to each operation step will be described. When the function of the current determination target operation step is the print or the scan, the calculation can be performed on the basis of the device processing capacity and the work load in each operation step. Also, in the case of the acknowledgement step, the calculation is performed from the past history or the like and the reference value for each function. The reference value refers to, for example, a rough indication of a process time. In the case of the "acknowledgement step", "1 day" or the like is the rough indication.

When No is determined in S1003, the use amount reservation carry-over control unit 2062 reserves the reserved use amount in the currently determination targeted nth step as the use amount for the next counting period (S1004), the reserved use amount in the nth step is deleted from the current counting period (S1005). For example, while 500 sheets are reserved as the use amount in the print step for March, when it is determined that the process in the relevant print step is to be performed in April, the process refers to a process for canceling the 500 sheets reserved for March 500 and reserving the relevant 500 sheets for April. As a result, the usable amount in the current counting period is increased by the cancelled use amount.

The work flow control unit 207 determines whether all the steps are set as determination targets or not. When all the steps are completed, the process is ended, and when all the steps are not completed, the processes are repeatedly performed from S1003 (S1006).

As a result, until the work flow is completed, also when the switching date and time of the counting period in the upper limit value management is past, the unprocessed reserved use amount before the switching date and time is carried over as the reserved use amount after the switching date and time, and thus it is possible to ensure the reserved use amount.

As a result, during the process in the work flow, the reserved use amount in the operation step where the time will pass the next counting period is released to another process, and thus it is possible to efficiently execute the other process.

In addition, the use amount reserved for the operation step reaching the next counting period may also be carried over for the next counting period. For example, when the print upper limit value for March is 1000 sheets and the print step with the reservation of 500 sheets is determined to enter April which is the next counting period, the 500 sheets for March is carried over for April as they are. As a result, the print upper limit value for March is changed to 500 sheets, and on the other hand, the print upper limit value for April is changed to 1500 sheets.

In this way, with the carry over system, it is possible to dynamically change the upper limit value in accordance with the level of the work amount.

Furthermore, the unprocessed use amount reserved in the work flow needs to be released for interrupting the high priority job, and a case is assumed where the desired completion date and time set in the work flow is set after the switching date and time of the counting period in the upper limit value management. In this case, the unprocessed reserved use amount before the switching date and time is carried over as the reserved use amount after the switching date and time. As a result, even when the interrupting job exists, if the completion date and time desired by the client of the work flow is after the switching date and time, it is possible to ensure the reserved use amount of the work flow.

Other Embodiment

Also, of course the aims of the present invention will be achieved by the following configurations. That is, a recording medium (or a storage medium) on which a program code of software for realizing the functions of the above-described embodiment is recorded is supplied to a system or an apparatus. Then, a computer (or a CPU, or an MPU) of the system or the apparatus reads and executes the program code stored on the recording medium. In this case, the program code itself read from the recording medium realizes the functions of the above-described embodiment, and the recording medium on which the program code is recorded constitutes the present invention.

In addition, by executing the program code read by the computer, in accordance with an instruction from the program code, an operating system (OS) running on the computer or the like performs a part or all of the actual process. The present invention of course includes such a case that the functions of the above-described embodiment are realized by the process.

Furthermore, the present invention of course includes such a case that the program code read from the recording medium is written to a memory which is provided to a function expansion card inserted into the computer or a function expansion unit connected to the computer. After that, in accordance with the instruction from the program code, the CPU or the like provided to the function expansion card or the function expansion unit performs the part or all of the processes and the functions of the above-described embodiment are realized by the process.

When the present invention is applied to the above-described recording medium, the recording medium stores the program code corresponding the flowchart described above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

It is noted that according to the above-described embodiment, the MFP apparatus is described as a main part but an information processing apparatus may mainly perform the above-described processes or the like as a host computer.

This application claims the benefit of Japanese Application No. 2006-244601 filed Sep. 8, 2006, which is hereby incorporated by reference herein in its entirety.

What is claimed is:

1. An apparatus comprising:

a management unit configured to manage an upper limit value of a use amount for each of a plurality of different functions in a plurality of steps included in a work flow;

a calculation unit configured to calculate a use amount for each of a plurality of different functions required for processing process information requested in the work flow before the work flow structured by the plurality of steps is executed;

a determination unit configured to determine whether an operation in the plurality of steps included in the work flow which uses the use amount can be executed or not based on the upper limit value of the use amount for each of the plurality of different functions managed by the management unit and the use amount for each of the plurality of different functions calculated by the calculation unit, wherein the determination unit compares the use amount for each of the plurality of different functions and the upper limit value of the use amount for each of the plurality of different functions, and determines that the operation in the plurality of steps included in the work flow cannot be executed when the use amount of at least one of the functions included in the work flow is larger than the upper limit value of the function; and a use amount control unit configured to reserve the use amount for each of the plurality of different functions which is calculated by the calculation unit before the work flow is executed when it is determined that the operation in the plurality of steps included in the work flow can be executed based on a determination result of the determination unit.

2. The apparatus according to claim 1, wherein the calculation unit calculates, based on information related to the work flow selected on an operation screen, before the work flow structured by the plurality of steps is executed, the use amount for each of the plurality of different functions required for processing the process information requested in the work flow.

3. The apparatus according to claim 1, wherein the use amount control unit sets the reserved use amount as a used amount when the reserved use amount is used in the operation of the corresponding step and wherein the management unit manages the use amount during the period based on the upper limit value, a used amount reserved for a step of another work flow, and the used amount.

4. The apparatus according to claim 3, wherein the use amount control unit deletes a reserved use amount related to operations in the step and subsequent steps in the work flow when the step included in the work flow is cancelled or has an error and wherein the management unit increases the usable amount by the deleted use amount in accordance with the deletion.

5. The apparatus according to claim 3, wherein the use amount control unit deletes a use amount reserved for operations in the step and subsequent steps in the work flow when there is a step whose operation is not completed when a predetermined period of time elapses in the work flow and wherein the management unit increases the usable amount by the deleted use amount in accordance with the deletion.

6. The apparatus according to claim 3, further comprising a notification unit configured to notify, based on the determination result of the determination unit, in the operation in the step, when it is determined that the operation that uses the use amount calculated in the calculation unit cannot be executed and also when it is determined that the use amount calculated in the calculation unit can be used if an already reserved and unused use amount for a step in another work flow is used, a reserving person of the other work flow of a process order change request regarding the step in the work flow.

7. The apparatus according to claim 3, further comprising an identification unit configured to identify a step whose process is not completed in a counting period for managing the upper limit value related to the use amount among the plurality of steps that structure the work flow, wherein the use amount control unit cancels the use amount reserved for the step identified by the identification unit among the plurality of steps and wherein the management unit increases the usable amount by the deleted use amount in accordance with the cancellation of the use amount.

8. The apparatus according to claim 1, further comprising a permission unit configured to, when the use amount control unit reserves the use amount calculated by the calculation unit for the plurality of steps included in the work flow, permit an execution of the process related to the work flow.

9. A method comprising:

managing an upper limit value of a use amount for each of a plurality of different functions in a plurality of steps included in a work flow;

calculating a use amount for each of a plurality of different functions required for processing process information requested in the work flow before the work flow structured by the plurality of steps is executed;

determining whether an operation in the plurality of steps included in the work flow which uses the use amount can be executed or not based on the managed upper limit value of the use amount for each of the plurality of different functions managed by the managing step and the calculated use amount for each of the plurality of different functions calculated by the calculation step, wherein the determining step compares the use amount for each of the plurality of different functions and the upper limit value of the use amount for each of the plurality of different functions, and determines that the operation in the plurality of steps included in the work flow cannot be executed when the use amount of at least one of the functions included in the work flow is larger than the upper limit value of the function; and reserving the use amount for each of the plurality of different functions which is calculated before the work flow is executed when it is determined that the operation in the plurality of steps included in the work flow can be executed.

10. A computer readable medium having thereon a computer-executable control program for causing the apparatus to execute:

managing an upper limit value of a use amount for each of a plurality of different functions in a plurality of steps included in a work flow;

calculating a use amount for each of a plurality of different functions required for processing process information requested in the work flow before the work flow structured by the plurality of steps is executed;

determining whether an operation in the plurality of steps included in the work flow which uses the use amount can be executed or not based on the managed upper limit value of the use amount for each of the plurality of different functions managed by the managing step and the calculated use amount for each of the plurality of different functions calculated by the calculation step, wherein the determining step compares the use amount for each of the plurality of different functions and the upper limit value of the use amount for each of the plurality of different functions, and determines that the operation in the plurality of steps included in the work flow cannot be executed when the use amount of at least one of the functions included in the work flow is larger than the upper limit value of the function; and reserving the use amount for each of the plurality of different functions which is calculated before the work flow is executed when it is determined that the operation in the plurality of steps included in the work flow can be executed.

* * * * *